United States Patent [19]

Ozawa

[11] 4,007,811

[45] Feb. 15, 1977

[54] CONTROL FOR ELEVATOR

[75] Inventor: Yasuhiko Ozawa, Inazawa, Japan

[73] Assignee: Mitsubishi Denki Kabushiki Kaisha, Japan

[22] Filed: Feb. 24, 1975

[21] Appl. No.: 552,206

[52] U.S. Cl. ..... 187/29 R

[51] Int. Cl.[2] ..... B66B 1/40

[58] Field of Search ..... 187/28, 29, 35

[56] References Cited

UNITED STATES PATENTS

| | | | |
|---|---|---|---|
| 3,469,657 | 9/1969 | Sgroi | 187/29 |
| 3,765,510 | 10/1973 | Richmon | 187/29 |
| 3,856,116 | 12/1974 | Savage | 187/29 X |

*Primary Examiner*—James R. Scott
*Assistant Examiner*—W. E. Duncanson, Jr.
*Attorney, Agent, or Firm*—Robert E. Burns; Emmanuel J. Lobato; Bruce L. Adams

[57] ABSTRACT

A looped strip connected to an elevator car is moved with the car and provided with floor indication cams at intervals equal to distances between adjacent landing floors. Immediately before the car already decelerated reaches a desired one of the floors, the corresponding cam engages one of two spaced switches to operate it. This instructs the car to further decelerate and the car is stopped on the desired floor upon that corresponding cam disengaging from the operated switch with the cam located between the switches in their inoperative position.

3 Claims, 3 Drawing Figures

FIG. 1
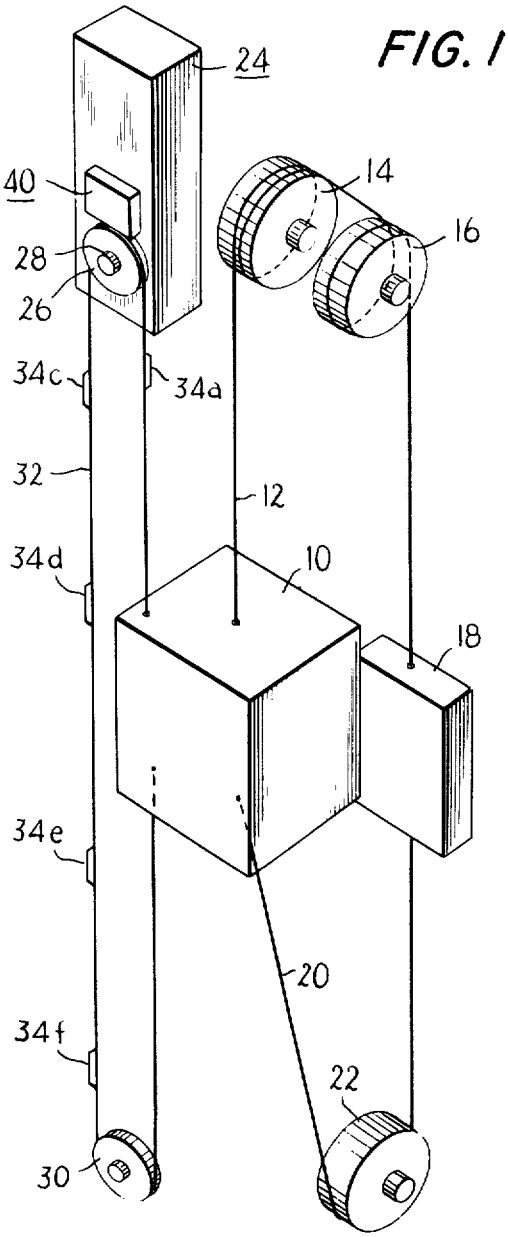
FIG. 2
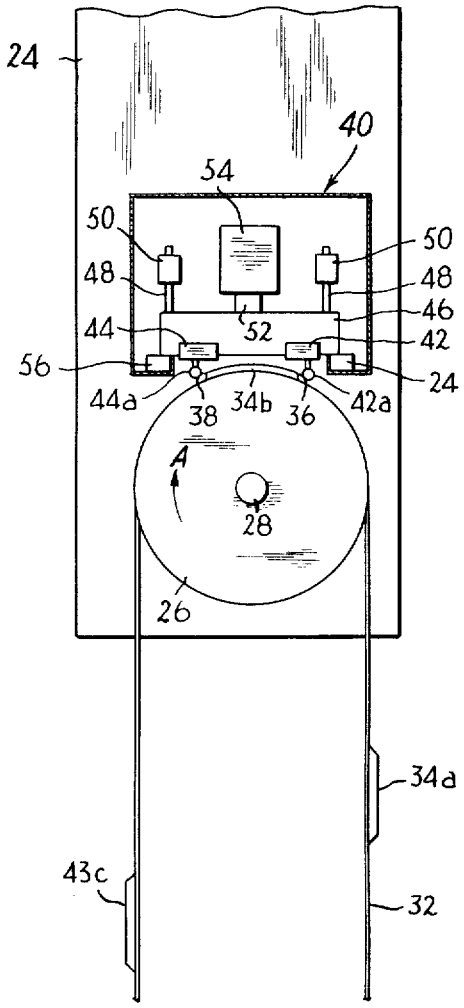
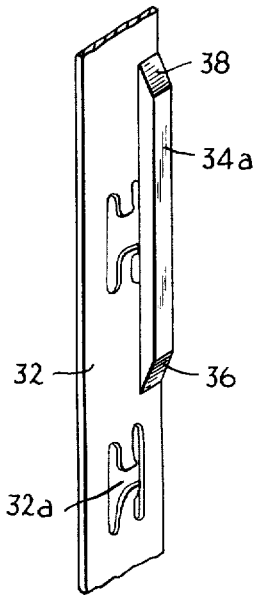
FIG. 3

CONTROL FOR ELEVATOR

BACKGROUND OF THE INVENTION

This invention relates to improvements in a control device for controlling an elevator system.

As one of means for controlling the movement of an elevator car, it has been common practice to control the elevator car through the medium of a model proportionally reducing the actual movement thereof. That means, however, is too insufficient in accuracy to accurately land the car on a desired one of the landing floors. In order to compensate for this insufficient accuracy, one landing switch for each landing floor could be disposed in each elevator shaft to be operated with the associated elevator car approaching each floor. Alternatively, it could be attempted to improve the landing accuracy by additionally using a second model smaller in reduced scale than the above-mentioned model to be effective for each of zones of landing operations alone.

The use of the landing switches has required various implements disposed on each elevator car and within each elevator shaft. This has encountered problems in view of the space occupied by such implements and the expensiveness, while it has been attended with dangers that may occur in adjusting, checking and maintaining those implements. The second model, though it is small in reduced scale, has included a fair error because its length is considerably reduced as compared with the actual distance put under control thereof within the associated shaft. Thus the use of the second model has not resulted in the elimination of the insufficiency of the desired accuracy.

SUMMARY OF THE INVENTION

Accordingly it is an object of the invention to provide a new and improved control device for controlling a position of an elevator car of an elevator system, with a high accuracy which device is inexpensive and can be expected to decrease the operations performed on the passageway.

The present invention accomplishes this object by the provision of a control device for controlling an elevator system, comprising an elevator car vertically movable within an elevator shaft, a flexible strip-shaped member having at least one end connected to the elevator car spanned in its tensioned state between a pair of spaced rotatable wheels to be moved within the elevator shaft at the same speed as the elevator car, a plurality of floor indication elements one for each of the landing floors disposed at predetermined intervals equal to distances between the adjacent landing floors, and means for selectively sensing the floor indication elements to produce corresponding outputs thereby to land the elevator car on that landing floor corresponding to the sensed floor indication element.

BRIEF DESCRIPTION OF THE DRAWINGS

The present invention will become more readily apparent from the following detailed description taken in conjunction with the accompanying drawings in which:

FIG. 1 is a simplified perspective view of a control device for controlling an elevator car constructed in accordance with the principles of the present invention;

FIG. 2 is a plan view of the sensor shown in FIG. 1; and

FIG. 3 is a perspective view of the position indicating cam shown in FIGS. 1 and 2.

DESCRIPTION OF THE PREFERRED EMBODIMENT

Referring now to FIG. 1 of the drawings, it is seen that an arrangement disclosed herein comprises an elevator car 10 arranged to ascend and descend within an elevator shaft (not shown). A hoisting rope 12 fixed at one end to the top of the elevator car 10, is disposed over a traction sheave 14 and a deflector wheel 16 and fixed at the other end to an upper end of a counter weight 18, and a compensating rope or cable 20 is disposed over a compensating wheel 22 to connect the lower end of the counter weight 18 to the lower portion of the elevator car 10. The traction sheave and deflector wheel 14 and 16 respectively are substantially at the same level and disposed within a machine room (not shown) above the upper end of the stroke of the elevator car 10. The traction sheave 14 serves to vertically move the car 10 within the shaft by means of an electric driving motor (not shown) and the deflector wheel 16 serves to hang the counter weight 18 on a suitable portion within the elevator shaft (not shown). The compensating rope 20 is operative to offset an unbalanced moment developed on the traction sheave 14. The compensating wheel 22 is disposed at the bottom of the elevator shaft (not shown) to impart a downward tension to the compensating rope 20.

The arrangement further comprises a control unit 24 suitably disposed within the machine room (not shown) above the upper end of the stroke of the elevator car 10, to control the position and speed of the car 10, the opening and closing of a door (not shown) for the car 10 and others, a sprocket wheel 26 fixedly secured on a shaft 28 (see FIG. 2) rotatably extending into the control unit 24, an idle wheel 30 disposed at the bottom of the elevator shaft (not shown) and a flexible perforated steel tape or strip carrier 32 connected at both ends to the elevator car 10 and spanned in its tensioned stated across the wheels 26 and 30. The sprocket wheel 26 is shown as being simply a plain wheel only for purposes of illustration.

The tape 32 is provided, on those portions deviating from the longitudinal axis thereof and including a number of perforation 32*a* (see FIG. 3), with a plurality of cams 32*a* through 34*f* one for each of the landing floors of a building in which the elevator system is installed although the landing floors are not shown only for purposes of illustration. Each cam serves to indicate a level of a corresponding floor and is spaced away from the adjacent cam by a distance equal to the actual distance between the corresponding landing floors. The indication cams are formed of any suitable resilient material such as rubber whereby the cams are prevented from adversely affecting the bending of the tape 32 as it passes over each of the wheels 26 or 30. As best shown in FIG. 3, the indication cam includes bevelled faces 36 and 38 at both ends opposite to each other lengthwise of the tape 32.

A sensor unit generally designated by the reference numeral 40 is disposed on the outer surface of the control unit 24 and above the sprocket wheel 26 to be selectively engageable by the indication cams 34*a* through 34*f* As best shown in FIG. 2, the sensor unit 40 comprises a pair of sensing switches 42 and 44 including respective operating rollers 42*a* and 44*a* and disposed in spaced relationship so that, when the elevator car 10 has its floor (not shown) flush with each of the landing floor (not shown), a corresponding one of the indication cams 34*a* through 34*f* comes just between the rollers 42*a* and 44*a* without the rollers 42*a* and 44*a* being physically contacted by the opposite bevelled faces 36 and 38 of the corresponding cam. A spacing formed between the roller 42*a* or 44*a* and the opposite bevelled cam face 36 or 38 is preferably of from 5 to 12 mm with the cam about 250 mm long. Under these circumstances, either the switch 42 or the switch 44 is operated when the elevator car 10 is moved from each floor through a distance of from 5 to 12 mm in either one of the down and up directions.

As shown in FIG. 2, the sensor unit 40 further comprises a movable connection plate 46 having the switches 42 and 44 attached thereto, and a pair of guide rods 48 projecting upwardly from the opposite end portions of the upper edge of the connection plate 46 to extend through respective bushings 50 suitably disposed within the sensor unit 40. An iron core 52 is centrally disposed at the upper edge of the connection plate 46 to upwardly extend into a solenoid coil 54 suitably disposed within the sensor unit 40. When excited, the solenoid coil 54 attracts the iron core 52 to upwardly move the connection plate 46 while the guide rods 48 are guided within the individual bushings 50 until the rollers 42 and 44 are retracted to their positions where the rollers do not interfere with that indication cam as passed over the sprocket wheel 26. The deenergization of the coil 54 causes the iron core 52 to be released whereby the switches 42 and 44 are permitted to be lowered to their positions as shown in FIG. 2 defined by stoppers 56 secured to the lower portion of the sensor unit 40 to abut against the lower edge of the connection plate 46.

The operation of the arrangement as shown in FIGS. 1 through 3 will now be described in conjunction with the downward movement of the elevator car 10. It is assumed that, with the door (not shown) of the elevator car 10 closed, the solenoid coil 54 in the sensor unit 40 is excited immediately prior to the start of the car 10. This causes the sensing switches 42 and 44 to be pulled up from their positions illustrated in FIG. 2 as above described. Under the assumed condition, the elevator car 10 movement is initiated so that it will be moved in the down direction to rotate the sprocket wheel 26 in the direction of the arrow shown in FIG. 2 through the tape 32 connected to the car 10. Under these circumstances the control unit 24 counts the number of rotations of the sprocket 26 through the utilization of the rotation of its shaft 28 to know the instantaneous position of the car 10 and the indication cams 34*a* through 34*f* are successively passed over the rotating sprocket wheel 26 without interfering with the switches 42 and 44 already raised to their upper positions as above described.

When the control unit 24 knows that landing floor on which the elevator car 10 is to land by having a call within the car or on that floor applied thereto, the same controls the car 10 approaching that floor to be decelerated. Upon the elevator car 10 reaching about 250 mm before the abovementioned landing floor, the control unit 24 delivers a signal for deenergizing the solenoid coil 54. This results in the switches 42 and 44 lowering to their positions as shown in FIG. 2. On the other hand, that indication cam corresponding to that landing floor on which the car 10 is attempted to land, in this case, the indication cam 34*b* approaches the switch 44 until the roller 44*a* on the switch 44 first rides on the cam 34*b* to operate the switch 44. As this operation of the switch 44 alone informs the control unit 24 of the elevator car 10 being still above the level of the desired floor, the control unit 24 instructs the car 10 to be further decelerated. Thus the elevator car 10 continues to be moved in the down direction while additionally decelerating.

During this downward movement of the elevator car 10, the cam 34*b* continues to be moved toward the switch 42 until the roller 44*a* on the switch 44 disengages from the bevelled face 38 of the cam 34*b*. At that time, the switch 44 is returned back to its inoperative position to apply a stopping signal to the control unit 24. Thus the control unit 24 immediately instructs the elevator car 10 to be stopped. Since the car 10 has sufficiently decelerated, it can land on the desired floor with the deviation of the car's floor from the landing floor ranging from 5 to 12 mm as above specified for the spacing between the roller 42*a* or 44*a* and the bevelled cam face 36 or 38 respectively.

If the stopped car 10 undershoots or overshoots the landing floor with a difference in level therebetween exceeding 12 mm for any reason then the bevelled cam face 36 or 38 pushes against the roller 42*a* or 44*a* to operate the associated switch 42 or 44 as the case may be. With the switch 42 operated, the control unit 24 is informed of the elevator car 10 having overshot the landing floor downwardly, and therefore instructs the car 10 to ascend. Similarly with the switch 44 operated, the control unit 24 will instruct the elevator car 10 to descend. In every case, when the elevator car 10 is caused to stop, both switches 42 and 44 are put in their inoperative position.

The process as above described is repeated to move the elevator car in the down or up direction. During the upward movement of the car indication cam first engages the switch 42 rather than the switch 44.

The present invention has several advantages. For example, the present device can control the operation of an elevator car with a high accuracy because the actual quantity of movement of the car in that condition is imparted to the control unit. The device is inexpensive to be manufactured due to the elimination of the necessity of disposing various implements in an elevator shaft within which an elevator car is moved.

While the invention has been illustrated and described in conjunction with a single preferred embodiment thereof it is to be understood that numerous changes and modifications may be resorted to without departing from the spirit and scope of the present invention. For example, the indication cams 34*a* through 34*f* and the switches 42 and 44 may be of the magnetic or optical type. If the magnetic type is desired, the tape may be of a magnetic material and include magnetized portions in place of the sensor cams while a magnetic sensor is substituted for each of the switches 42 or 44. Alternatively the indication cams may be formed of a rubber magnet with reed switches substituted for the switches 42 and 44. If the optical type is desired, the tape 32 may include apertures in the positions of the cams 34*a* through 34*f* and light may fall upon photoelectric elements through the selected apertures. Alternatively the tape may have one surface from which light is reflected and in place of the indication cams the reflecting surface includes the portions different in reflection factor or angle of reflection from the remaining portion thereof in order to control a quantity of light incident upon an associated light receiving element. Further the tape may be replaced by a rope operatively associated with a governor (not shown) for detecting overspeeds of the elevator car 10. Further the present invention is equally applicable to a variety of moving members traveling along their predetermined passageways.

What is claimed is:

1. In combination with an elevator car operable upwardly and downwardly, a control device for controlling the accurate stopping of the elevator at the various floors comprising, a flexible strip carrier movable longitudinally in opposite directions synchronously and directly proportional to the upward and downward travel of the elevator and in response to said travel, means on said strip carrier comprising floor-indicator elements spaced apart thereon at distances corresponding to distances the elevator car must travel between floors and be stopped accurately at the level of said floors and travelling with said strip carrier, sensing means at a sensing position detecting the arrival of said floor-indicator elements at said sensing position for developing a command signal to stop said elevator car upon sensing and detection of individual floor-indication elements at said sensing position, thereby to land said elevator car accurately on the floor corresponding to the floor-indication element, and means for automatically moving the sensing means away from said sensing position and to restore said sensing means to said sensing means when a sensing of the floor-indication elements is to take place in dependence upon impending arrival of said car at a floor corresponding to a given floor-indicating element and whose arrival at said sensing position is impending.

2. The combination according to claim 1, in which said strip carrier comprises a strip of flexible material connected at least at one end to said elevator car, for moving said strip longitudinally directly proportional to and under the control of upward and downward movement of said elevator car, and rotatable guide means over which said strip carrier is disposed for guided travel thereon.

3. The combination according to claim 2, in which said sensing means comprises a pair of switches, and in which said floor-indication elements comprise a plurality of cam means for camming said switches, one of said switches having means operable by a cam means for developing a command signal to decelerate the elevator car and the other switch having means operable upon disengagement by said cam means to develop a stop command signal for stopping said elevator car.

* * * * *